US005887717A

United States Patent [19]

Anderson et al.

[11] Patent Number: 5,887,717

[45] Date of Patent: Mar. 30, 1999

[54] PACKAGE ASSEMBLIES FOR CONTAINERS

[75] Inventors: Dale C. Anderson, Fridley; Donald J. Lasecke, Arden Hills, both of Minn.

[73] Assignee: Delkor Systems, Inc., Minneapolis, Minn.

[21] Appl. No.: 747,442

[22] Filed: Nov. 12, 1996

Related U.S. Application Data

[63] Continuation-in-part of Ser. No. 613,682, Mar. 11, 1996, which is a continuation-in-part of Ser. No. 349,835, Dec. 6, 1994, abandoned, which is a continuation-in-part of Ser. No. 134,494, Oct. 8, 1993, abandoned, which is a continuation of Ser. No. 896,146, Jun. 9, 1992, abandoned.

[51] Int. Cl.[6] ..... B65D 81/00

[52] U.S. Cl. ..... 206/460; 206/497

[58] Field of Search ..... 206/427, 432, 206/460, 497

[56] References Cited

U.S. PATENT DOCUMENTS

| | | | |
|---|---|---|---|
| 3,198,327 | 8/1965 | Boehling et al. | 206/432 |
| 3,312,340 | 4/1967 | Face . | |
| 3,331,503 | 7/1967 | Brown | 206/432 |
| 3,477,564 | 11/1969 | Crabtree | 206/432 |
| 3,542,193 | 11/1970 | Hewlett et al. . | |
| 3,675,767 | 7/1972 | Taylor . | |
| 3,734,280 | 5/1973 | Amneus et al. . | |
| 3,878,943 | 4/1975 | Ryan et al. . | |
| 3,883,000 | 5/1975 | Gibbs . | |
| 3,885,671 | 5/1975 | Spiegel et al. . | |
| 4,050,579 | 9/1977 | Gorski et al. . | |
| 4,055,249 | 10/1977 | Kojima . | |
| 4,304,332 | 12/1981 | Danti . | |
| 4,387,808 | 6/1983 | Dornbusch | 206/460 |
| 4,505,389 | 3/1985 | Whiteside . | |
| 5,083,674 | 1/1992 | Clark | 206/508 |

FOREIGN PATENT DOCUMENTS 1191819 8/1985 Canada .

2387172 11/1978 France .

OTHER PUBLICATIONS

"Dairy Industry Pioneers New Reduced Shipper", Dairy Field, Feb. 1992, p. 42.

"Colorado Dairy Pioneers Use of New Source–Reduced Shipper", Good Packaging Magazine, p. 20.

*Packaging System Reduces Material Content, Food Engineering*, Sep. 1991, p. 70.

"*Source Reduced Shippers Get Minnesota Grant*", Food Processing, Jul. 1991.

"*Savings Come as Shippers Go*", Packaging Digest, Dec. 1991.

*Beyond the Corrugated Box*, Dairy Foods, 1991.

*Primary Examiner*—Jim Foster

*Attorney, Agent, or Firm*—Vidas, Arrett & Steinkraus

[57] ABSTRACT

Improved package assemblies for containers, the packaging assemblies comprising a rigid base member having at least one row of containers removably secured to the base member by frangible adhesive, a cover member and a film of plastic material passing over the base member, the containers and the cover member and secured to itself to further secure the containers in assembly therewith. An improved package assembly according to the present invention may also have at least two layers of containers, such a package assembly comprising a rigid base member, a first layer of containers removably secured to the base member by frangible adhesive, at least one additional layer of containers removably secured to at least one intermediate pad by frangible adhesive, said at least one additional layer being placed on top of the first layer of containers, a cover member placed over the uppermost layer of containers, and a film of plastic material passing over the base member, the containers, the at least one intermediate pad and the cover member and secured to itself to further secure the containers in assembly therewith. The containers are removable from the assembly by removing the plastic film and cover member and separating the containers from the base member and/or intermediate pad by breaking the frangible adhesive.

17 Claims, 12 Drawing Sheets

PACKAGE ASSEMBLIES FOR CONTAINERS

CROSS REFERENCE TO RELATED APPLICATIONS

This application is a Continuation-in-Part of U.S. patent application Ser. No. 08/349,835 filed Dec. 6, 1994, abandoned; this application is also a Continuation-in-Part of U.S. patent application Ser. No. 08/613,682 filed Mar. 11, 1996 pending (a Continuation-in-Part of 08/134,494 filed Oct. 8, 1993, abandoned, which is a Continuation of Ser. No. 07/896,146 filed Jun., 9, 1992) abandoned; all of the above U.S. Patent Applications being incorporated herein by reference.

BACKGROUND OF THE INVENTION

1. Field of the Invention

This invention relates to package assemblies, and more particularly to shrink wrapped container package assemblies having a rigid base member, at least one row of containers removably secured to the base member by frangible adhesive, and a cover member, in addition to shrink wrapped container package assemblies having at least two layers of containers and comprising a rigid base member, a first layer of containers comprising at least one row of containers removably secured to the base member by frangible adhesive, at least one additional layer of containers removably secured to at least one intermediate base member by frangible adhesive, said additional layer being placed on top of said first layer of containers, and a cover member over the uppermost layer of containers.

2. Description of the Related Art

Prior art packages and packaging methods do not address the special problem of packaging containers of unequal dimensions. A variety of variables affect the stability of a packaging assembly. These variables include the size of the container, the shape of the container, the temperature of the container, the degree of bonding possible between the container bottom and the base member, which is related to the size of the bonding surface at the base of the container, the weight of the containers, the size of the packaging assembly and the modes of distribution and handling of a packaging assembly.

Applicants have learned that these variables must be carefully controlled to avoid release of the frangible adhesive bond during handling and distribution. The adhesive bond between the containers and the base member has proven to be a key factor in the maintenance of package strength and stability. If the adhesive bond releases during distribution, it can result in package failure and lead to product damage.

SUMMARY OF THE INVENTION

Various steps were explored to solve the problems related to packaging containers of unequal dimensions and increased height. It was discovered that a packaging assembly comprising a planar corrugated base member, a frangible adhesive bond between the base member and the containers, a planar cover member placed on top of the containers and a layer of plastic material solved the problem of packaging taller containers of unequal dimensions.

Accordingly, the present invention provides a container package assembly comprising a rigid planar base member having at least one row of containers removably secured to the base member by frangible adhesive, a planar cover member placed on the containers such that the containers are "sandwiched" between the base member and the cover member, and a film of plastic material passing over the base member. The plastic material or overwrap is secured over the containers, cover member and base member to further secure the containers in assembly therewith. The containers are removable from the assembly by removing the plastic film and cover member and separating the containers from the base member by breaking the frangible adhesive. The containers separate cleanly from the base member without the need of a tear strip, as disclosed in the prior art.

An enlarged fragmentary perspective view of such a prior art packaging assembly according to U.S. Pat. No. 4,505,389 incorporated herein by reference, is shown at FIG. 1. The packaging assembly of the present invention provides an improvement over such previous packaging assemblies for containers of the type requiring a base member 1 with tear strips 2, onto which packages (not shown) are removably secured by frangible adhesive 3 in a predetermined pattern on the tear strips.

The rigid base member of the present invention requires no tear strips, and uses an improved frangible adhesive to removably secure the containers to the base member. Spots of adhesive may be used, although a configuration with strips of frangible adhesive is preferred. The planar cover member provides an unexpectedly high degree of stability to the containers.

The improved package assembly for containers of the present invention is therefore suitable for use with containers of unequal dimensions, such as tubs and the like having a narrower base than top, for example. The present invention is of particular utility with such containers of unequal dimensions of increased height and volume and/or with a high center of gravity, especially such containers which have a smaller base.

Applicants have discovered that packaging of containers of unequal dimensions presents unique problems where the size, weight and volume of such containers increases. As the volume of such a container increases, its center of gravity reaches a point at which during normal handling, the frangible bond between the container and base member is broken. Once this bond is broken, the package loses its shape and strength. This can affect the stability of the entire pallet of packages.

Applicants have experienced package failure resulting from a combination of container size, shape, and weight, and distribution and handling methods. Release of frangible adhesive bond has occurred during the distribution process, resulting in package failure.

Re-handling of any sort poses a problem, whether by hand or by machine. In addition, mixed pallets, comprising stacks of packages wherein successive package layers may be of different heights, may also compromise stability. In such cases, those skilled in the art have determined that the only option is returning to the use of boxes.

A need exists for a package assembly for containers having a container base and a container top, wherein the container base is smaller than the container top, and the container has a large height and weight relative to the size of the container base, which is cost effective, provides unitary stability and stability when palletized, and provides stability throughout customary handling procedures.

Therefore, an additional aspect of the present invention provides shrink wrapped packaging assemblies having at least two layers of containers. Such multiple layer packaging assemblies for containers comprise a first package layer, said layer comprising at least one row of containers removably secured to a rigid planar base member by frangible adhesive, the dimensions of the base member being equal to or greater than the lower perimeter of the first layer of containers, but also being less than or equal to the upper perimeter of the first layer of containers. The packaging assembly further comprises at least one additional package layer, said additional layer comprising at least one row of containers removably secured by frangible adhesive to an intermediate planar pad having the same size and dimensions as the rigid base member. The adhesive is preferably provided in strips, and may be provided in the form of one or more strips per row of containers. The packaging assembly further comprises a planar cover member which sits on top of the uppermost packaging layer within the perimeter of the containers of said layer. A film of plastic shrink wrap material extends over the packaging layers and the cover member, and is secured to itself to further secure the containers in assembly therewith. The containers are removable from the assembly by removing the plastic film and cover member and separating the containers from the base member and/or intermediate pad by breaking the frangible adhesive.

Applicant has recognized that prior art packages and packaging methods do not address the special problem of providing a packaging assembly which minimizes materials while providing an area for displaying signage or billboards, product coding identification for handling in a system, UPC coding, bar coding or the like on multiple sides of the packaging assembly. Applicant has explored various steps to solve the problems related to conveying easily accessible product information. It has been found that a packaging assembly according to the present invention also solves the problem of providing easily accessible product information in a container package assembly which provides the advantages of clean separation from the base member. Product information, signage and UPC coding on the individual containers packaged is clearly visible. Packaging assemblies according to the present invention are further suitable for a wide array of container types including containers of unequal dimensions, such as tubs and the like having a narrower base than top, containers having a increased height and volume and/or with a high center of gravity, including containers with a smaller base than top and containers with a larger base than top, in addition to cylindrical containers of plastic, metal, paper, plastic coated paper or glass. A base member or intermediate member comprising a tray with four side walls would be of particular utility with glass containers, and would provide additional area on the side walls for providing additional product information.

DESCRIPTION OF THE PREFERRED EMBODIMENTS

Figure 1:
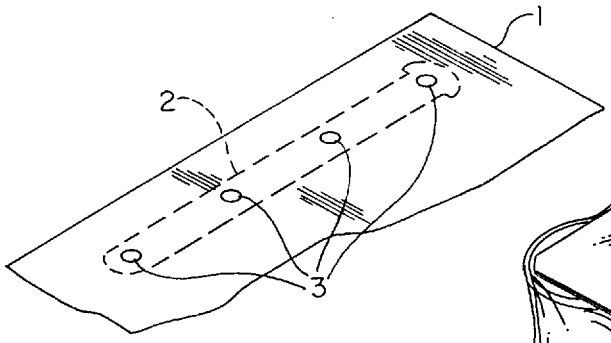
FIG. 1 is an enlarged fragmentary perspective view of prior art.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

In one aspect, the present invention provides a container package assembly comprising a rigid planar base member having at least one strip of frangible adhesive, at least one row of containers removably secured to the base member by said adhesive strip, a planar cover member placed on the containers such that the containers are "sandwiched" between the base member and the cover member, and a film of plastic material passing over the base member. The plastic material or overwrap is secured over the containers, cover member and base member to further secure the containers in assembly therewith.

Figure 2:
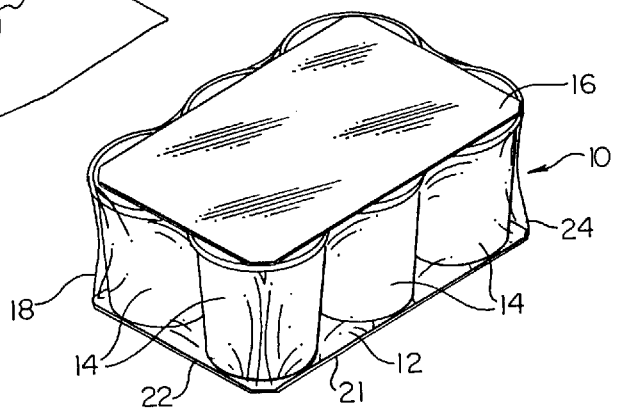
FIG. 2 is a perspective view of a container package assembly according to the present invention showing a base member with containers adhered thereto, having a cover member and shrink wrap applied thereto.

Referring to FIG. 2, an assembled container package unit is shown generally at 10, and comprises a flat, rectangular base member 12 onto which containers 14 are adhered to form a container array 15 on said base member 12, a cover member 16, and shrink wrap 18. Base member 12 is made of corrugated board.

The base and cover member are generally rectangular, and may each have four clipped corners (as shown at FIG. 2) or four rounded comers (see FIGS. 19, 21, 23 and 25).

Figure 3:
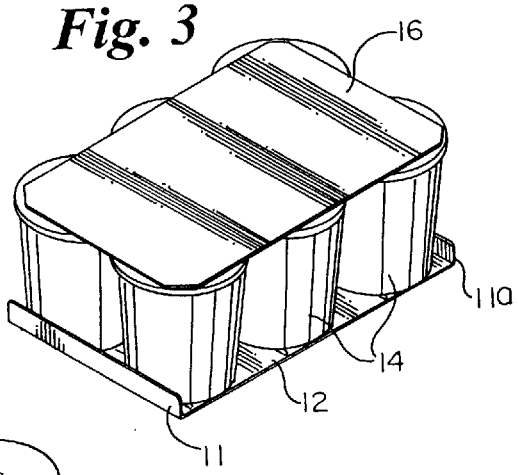
FIG. 3 is a perspective view of a container package assembly according to the present invention prior to application of the shrink wrap and showing an alternative base member with vertical end flaps.
Figure 4:
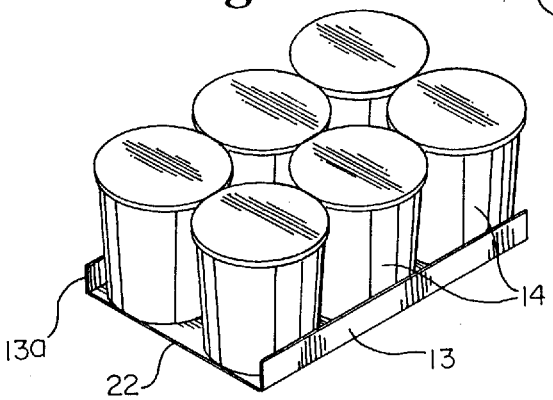
FIG. 4 is a perspective view of a container package assembly according to the present invention prior to application of the cover member and shrink wrap and showing another alternative base member with vertical side flaps.

Examples of alternative configurations for base members are shown in FIGS. 3 and 4, the base members having either opposite side walls 11,11*a* as shown in FIG. 3 or opposite end walls 13,13*a* as shown in FIG. 4. Where the containers have a container base which is smaller than the container top, the most preferred base member has dimensions no greater than the top dimension of the array of containers and no less than the bottom dimension of the array of containers.

Cover member 16 may be made of any suitable material such as chip board or paper board, although corrugated board may also be used. Cover member 16 may be as rigid as base member 12. Chip board possesses the minimum rigidity necessary to impart the desired degree of stability to the package assembly according to the present invention. After placement of cover member 16, shrink wrap 18 is adhered over containers 14, base member 12 and cover member 16. In a most preferred embodiment, the dimensions of the cover member are less than or equal to the perimeter of the top of the container array defined by the tops of the containers of the container array.

Figure 6:
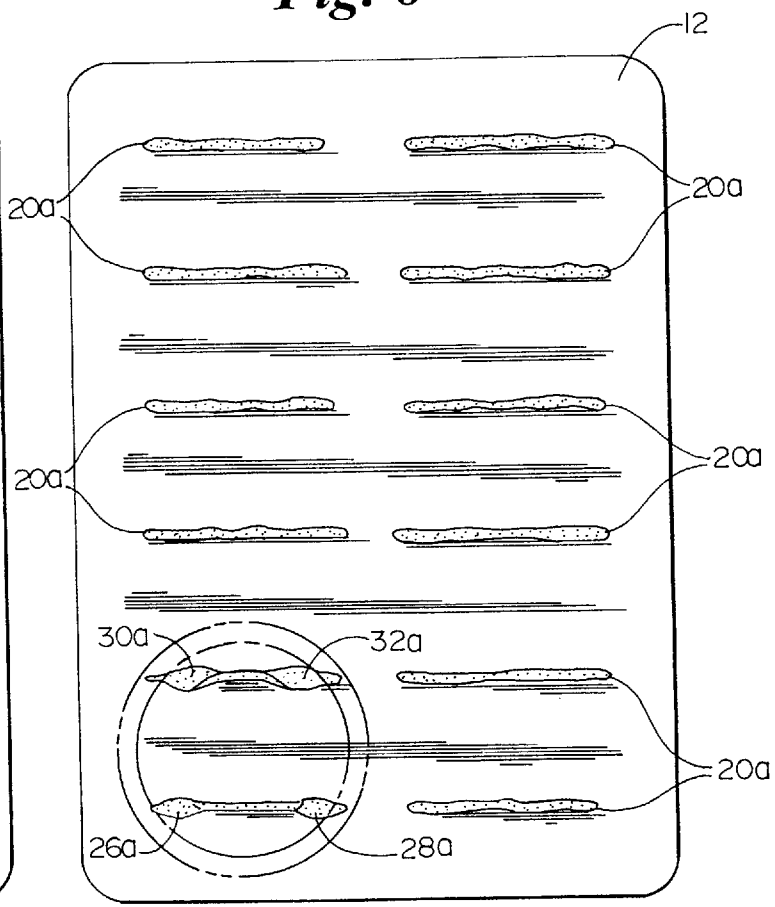
FIG. 6 is a perspective view of a base member as in FIG. 1 with intermittent strips of adhesive applied thereon.
Figure 5:
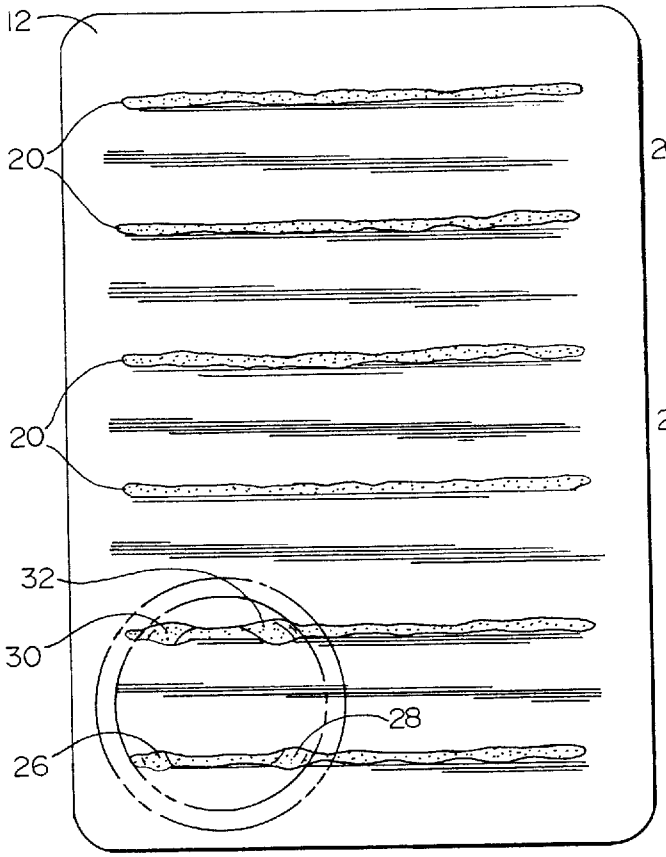
FIG. 5 is a perspective view of a base member of a container package assembly according to the present invention with strips of adhesive applied thereon.

By means of appropriate adhesive dispensing equipment the nature of which will be readily apparent to those skilled in the art, frangible adhesive is placed on the upper surface 21 of base member 12, preferably in the form of strips 20. As shown in FIGS. 5–6, adhesive strips 20 are disposed parallel to ends 22 and 24 of base member 12. The adhesive is a hot melt, frangible adhesive which may be applied by applicators situated above a conveyor along which base member 12 is traveling.

FIG. 6 shows an alternative embodiment of the invention, in which adhesive strips 20*a* are intermittent, so that the adhesive strips extend only beneath the individual containers and not between them.

While the adhesive is still molten, containers 14 are placed in an adjacent side by side relationship on adhesive strips 20 on base member 12, as shown in FIGS. 2–4. Containers 14 touch the adhesive at two contact points, or at four contact points, as shown in FIGS. 5 and 6 at 26, 28, 30 and 32 and 26*a*, 28*a*, 30*a* and 32*a*, respectively, in which strips of frangible adhesive, after a container has been affixed thereto and removed, are shown for purposes of illustration. Bonding takes only a few seconds.

Once containers 14 are in place on base member 12, cover member 16 is placed on top of containers 14. Where the containers have a container base which is smaller than the container top, the cover member is ideally of the same dimensions as the base member, although any smaller size cover member which provides significant contact with all containers (covering at least about 25% of the top area of each container) may be sufficient.

After placement of cover member 16, shrink wrap 18 is applied. Shrink wrap 18 may be applied by means of a shrink wrap applicator and shrink tunnel, or other means recognized in the art. An example of a suitable shrink film is a 1.5-mil low-density polyethylene, commercially available from Armin Plastics.

The package assembly including the base member 12 with containers 14, cover member 16 and shrink wrap 18 applied thereto is shown in FIG. 2.

Frangible adhesive strips 20 hold containers 14 firmly in place on base member 12. Containers 14 and cover member 16 are used as the support structure of the container package assembly. The adhesive is such that it will adhere to containers 14 to the extent that containers 14 are secured to base member 12 firmly enough to, in conjunction with cover member 16, resist movement relative thereto during normal handling. Since the center of gravity of containers 14 may cause the adhesive to break during handling without cover member 16, cover member 16 serves to prevent premature breaking of the frangible bond, and retain the shape of the package assembly should such breakage occur.

Containers 14 are removable from the assembly by removing plastic film 18 and cover member 16 and separating containers 14 from the base member 12 by breaking the frangible adhesive. The adhesive can be broken by manual force by grasping and twisting an individual container and separating it from base member 12. In accordance with the above method, containers 14 uniformly separate cleanly from base member 12 without the need of a tear strip, as disclosed in the prior art. Containers 14 may be retained on base member 12 until their removal is desired.

Cover member 16 provides stability needed for handling containers of unequal dimensions which have a high center of gravity, or have a small base relative to their height and weight. The improved package assembly for containers of the present invention is therefore suitable for use with containers of unequal dimensions, such as tubs and the like having a narrower base than top portion or a smaller base diameter than top diameter. The present invention is of particular utility with such containers of unequal dimensions of increased height and volume and/or with a high center of gravity, especially such containers having a smaller base, and containers that are unstable because they tip easily due to the relationship between the diameter of the base, the height and weight thereof.

The following list of containers are exemplary of those containers 14 with which the inventive single layer packaging assembly is of particular utility:

1. 32 oz. polypropylene container with 4.125" top diameter, 6.25" height and 2.875" base diameter when packaged into a 2×3 pack pattern in one layer.
2. 32 oz. polypropylene container with a 4.625" top diameter, 5.625" height and 3.25" base diameter when packaged into a 2×3 pack pattern in one layer.
3. 48 oz. polypropylene container with 5.0" top diameter, 6.75" height and 3.375" base diameter when packaged into a 2×3 pack pattern in one layer.
4. 5 lb., 6 oz. high density polyethylene container with 6.625" top diameter, 5.75" height and 5.25" base diameter when packaged into a 2×2 pack pattern in one layer.
5. 6 oz. polypropylene container with 3.25" top diameter, 3.0" height and 2.125" base diameter with false bottom base (container rim is only part of base to contact frangible adhesive) when packaged in a 3×4 pack pattern in one layer. 8 oz. polypropylene containers may also be packaged in such a configuration.
6. 1 liter polypropylene container with 4.625" top diameter, 5.5" height and 3.5" base diameter when packaged in a 2×3 pack pattern in one layer.
7. 150 gram polystyrene container with 2.625" top diameter, 3.375" height and 1.875" base diameter in a 3×4 pack pattern in one layer.

In particular, the unexpected combination of a frangible adhesive bond between the containers and the base member, with an additional cover member over the containers, cooperates to effectively secure the containers, to prevent shingling, i.e., overlapping of container tops, and prevent release of the adhesive bond between the base member and the containers.

Such an improved package assembly is also of utility with containers having a tapered shape with the top having a smaller profile than the bottom, which has been found to be suitable for packaging according to the present invention with a cover member to minimize the effects of shrink wrap tension on the adhesive bond.

When packaging containers of unequal dimensions, unique problems arise. Factors such as container size, shape, weight and volume, in addition to distribution and handling methods can result in package failure. Where the size, weight and volume of such containers increase, the center of gravity of a container reaches a point at which during normal handling, the frangible bond between the container and base member is broken. Once this bond is broken, the package loses its shape and strength. This can affect the stability of the entire pallet of packages. Release of the frangible adhesive bond during the distribution process will result in package failure.

Re-handling of any sort poses a problem, whether by hand or by machine. In addition, mixed pallets, comprising stacks of packages wherein successive package layers may be of different heights, may also compromise stability. In such cases, those skilled in the art have determined that the only option is returning to the use of boxes.

In another aspect, the present invention provides a package assembly for high volume containers of unequal dimensions, containers of increased height and volume relative to the diameter of the base thereof, and containers having a top with a larger diameter than the diameter of the base, which is cost effective, provides unitary stability and stability when palletized, and provides stability throughout customary handling procedures.

An alternative packaging assembly according to the present invention is a shrink wrapped packaging assembly having at least two layers of containers. Each layer of the package will comprise at least one row of containers removably secured to a rigid planar member by frangible adhesive, preferably provided in the form of at least one strip. The packaging assembly further comprises a planar cover member which sits on top of the uppermost packaging layer within the perimeter of the containers of said layer. A film of plastic shrink wrap material extends over the packaging layers and the cover member, and is secured to itself to further secure the containers in assembly therewith. The containers are removable from the assembly by removing the plastic film and cover member and separating the containers from the base member and/or intermediate pad by breaking the frangible adhesive.

Figure 9:
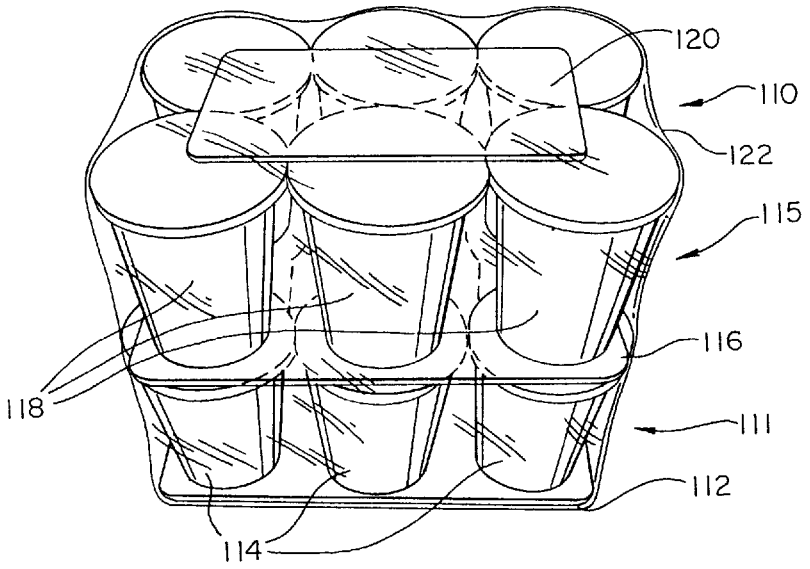
FIGS. 9–10 are views of a container package assembly according to the present invention showing the base member with containers adhered thereto, an intermediate pad with containers adhered thereto and shrink wrap applied thereto.
Figure 10:
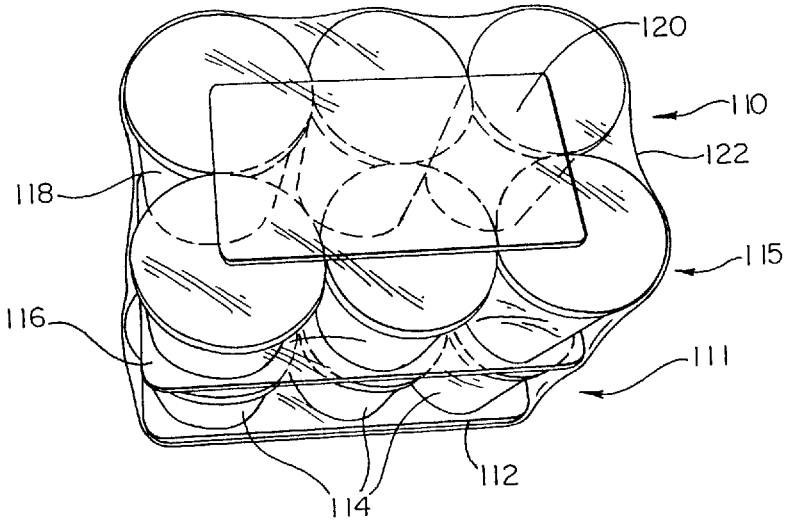
Figure 11:
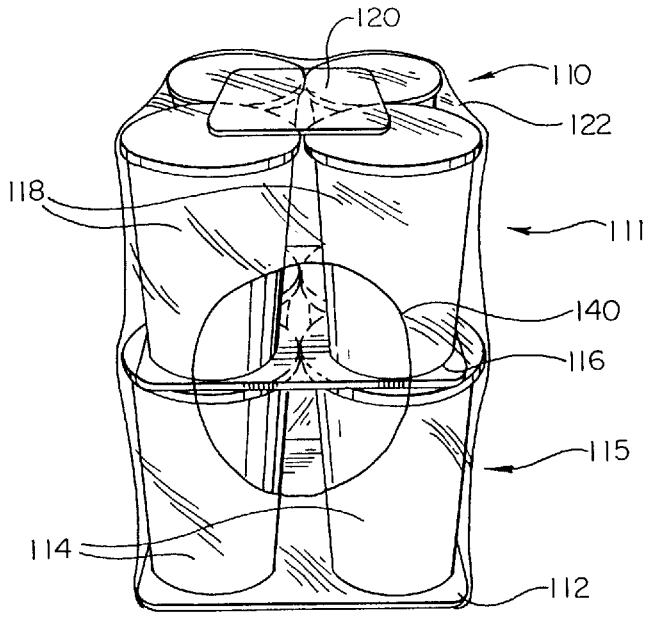
FIG. 11 is an end view of a container package assembly similar to the package assembly shown in FIGS. 9–10.

Referring to FIGS. 9–11 an assembled multi layer container package unit according to the present invention is shown generally at 110, and comprises a first container layer shown generally at 111 which comprises corrugated base member 112 onto which containers 114 are removably secured, and a second container layer shown generally at 115 comprising intermediate member 116 (which has the same dimensions as base member 112) onto which containers 118 are removably secured. The second container layer 115 is placed over the first container layer 111. Cover member 120 is placed over second container layer 115. Shrink wrap 122 is adhered over first container layer 111, second container layer 115, and cover member 120 and secured to itself to further secure the containers in assembly therewith.

Figure 7:
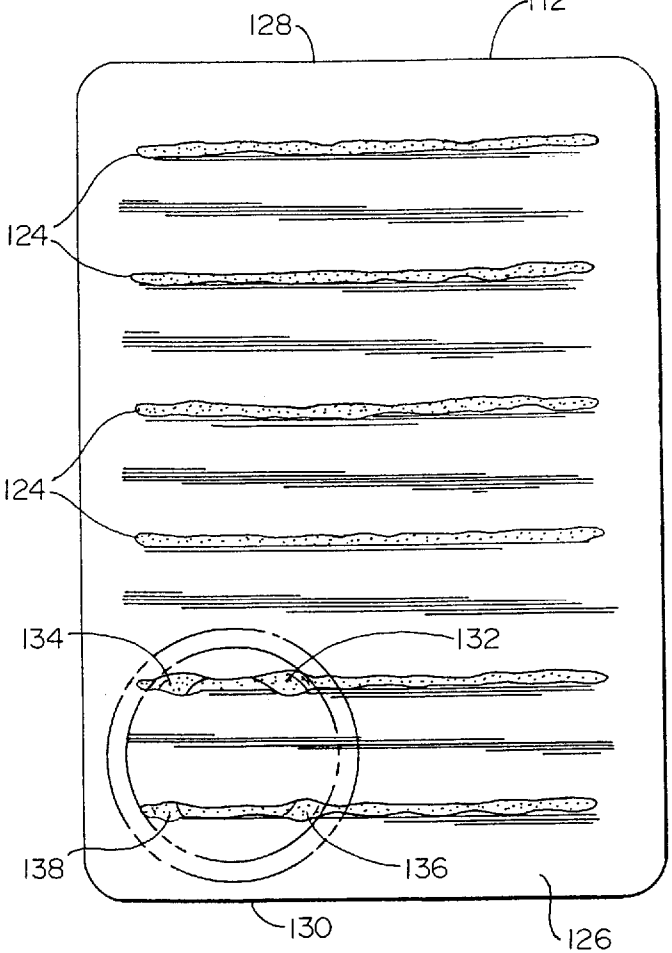
FIG. 7 is a plan view of the base member of an alternative embodiment of the present invention with continuous strips of frangible adhesive applied thereto.

Base member 112 and intermediate member 116 are made of corrugated board and are of the same dimensions. Containers 114 of first container layer 111 and containers 118 of second container layer 115 are also the same size, each layer comprising the same number and arrangement of containers. Each package layer will comprise at least one row of containers. In the most preferred embodiment, as shown at FIGS. 6 and 7, the dimensions of base member 112 and intermediate member 116 are greater than or equal to the lower perimeter of the container layers and less than or equal to the upper perimeter of the container layers. The intermediate member and base member of the packaging assemblies according to the present invention are the same size and shape.

Figure 8:
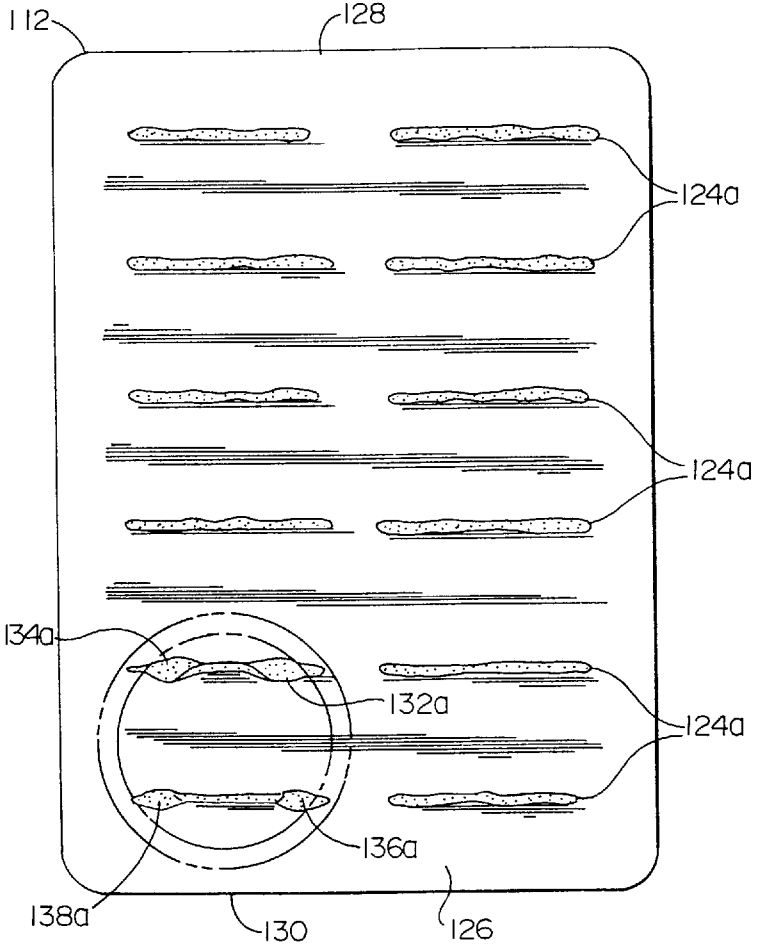
FIG. 8 is a plan view of a base member of an alternative embodiment of the present invention with intermittent strips of frangible adhesive applied thereto.

By means of appropriate adhesive dispensing equipment the nature of which will be readily apparent to those skilled in the art, strips of frangible adhesive 124 are placed on the upper surface 126 of base member 112, as shown in FIGS. 7–8, adhesive strips 124 being disposed parallel to ends 128 and 130 of base member 112. The adhesive is a hot melt, frangible adhesive which may be applied by applicators situated above a conveyor along which base member 112 is traveling. The frangible adhesive may be the same as that used in U.S. Pat. No. 4,505,389. One such adhesive is commercially available from Swift Adhesives, Inc. of 383 Orendo Road, Bramalea, Ontario LGT-164 as Nicolmelt® hot melt adhesive. Other such adhesives are commercially available as well, such as H. B. Fuller Product HL-7505. As shown in FIG. 8, adhesive strips 124*a* may be intermittent, so that the adhesive strips extend only beneath the individual containers and not between them.

While the adhesive is still molten, containers 114 are placed in an adjacent side by side relationship on adhesive strips 124 on base member 112, as shown in FIG. 9. Containers 114 may be positioned on base member 112 by equipment which feeds containers 114 in a direction perpendicularly to the direction in which base member 112 is traveling, and then positions a pre-arranged set of containers 114 on base member 112 immediately after adhesive strips 124 have been applied thereto. Containers 114 touch the adhesive at two contact points, or at four contact points, as shown in FIGS. 7 and 8 at 132, 134, 136 and 138 and 132*a*, 134*a*, 136*a* and 138*a*, respectively, in which strips of frangible adhesive, after a container has been affixed thereto and removed, are shown for purposes of illustration. Bonding takes only a few seconds.

Containers 118 are placed on intermediate member 116 in the same manner in which containers 114 are positioned on base member 112, by positioning means situated above a conveyor along which base member 112 and intermediate member 116 are traveling. The same equipment which positions containers 114, 118 on the base and intermediate members as they travel along a conveyor belt may be used to pick up the second container layer 115 (intermediate member 116 with containers 118 adhered thereto), thereby allowing the first container layer 111 (base member 112 and containers 114 adhered thereto) to be conveyed to a position beneath suspended second container layer 111. The second container layer 115 is then placed on top of the first container layer 111. The equipment that accomplishes this "pick up" and "placement" function may include multiple suction means in a pattern corresponding to the pattern of containers in the packaging assembly. First and second container layers 111,115 are identical until one container layer is placed on top of another in the manner described above.

The "pick up" and "placement" steps may be repeated to form a container package assembly with more than two layers. Once the uppermost layer of containers is in place, planar cover member 120 is placed on top of containers 118.

Cover member 120 may be made of any suitable material including corrugated board or chip board. Maximum stability and package strength is achieved by providing a corrugated cover member the dimensions of which are less than the top dimension of the containers. Cover member 120 sits within the perimeter of the containers of the uppermost layer. The uncovered surfaces of the containers in the uppermost layer extend partially beyond the sides and ends of the cover member, permitting the shrink wrap film 122 to maintain tight contact with the rims of the container tops 119.

The size of the cover member of the multiple layer packaging assembly is an important feature. It has been found that maximum stability and package strength of such a packaging assembly is achieved by providing a cover member the dimensions of which are the same as or less than the top dimension of the array of containers. In such an arrangement, the uncovered surfaces of the containers extend partially beyond the sides and ends of the cover member, permitting the shrink wrap film to maintain tight contact with the rims of the container tops.

Accordingly, in the preferred embodiment of the multiple layer package assembly, the length of the cover member is the same as or more preferably less than the sum of the diameters of the containers extending therebeneath, and the width of the cover member is the same as or more preferably less than the sum of the diameters of the containers extending therebeneath. In other words, the length of the opposite sides of such a cover member is the same as or less than the sum of the diameters of the tops of the containers of the uppermost layer, and the length of the opposite ends of the cover member is the same as or less than the sum of the diameters of the tops of the containers extending beneath said ends, as shown in FIGS. 9–11 and 19–25.

When positioned on top of all containers, the cover member serves to limit up and down movement of the containers. The cover member must be positioned on top of all containers, to effectively control or prevent chiming or shingling, i.e. container movement causing the upper edge or top of a container to rest on the top of an adjacent container. A smaller cover member which provides significant contact with all containers may be sufficient. The smallest effective cover member will cover at least about one quarter of each container top in each layer. The most preferred cover member will lie just within the perimeter defined by the tops of the container array on which it is positioned.

While the cover member limits up and down movement of the containers, the shrinkwrap film in contact with the container rims serves to limit side movement. The result is maximum restriction of internal container movement which greatly limits the release of frangible adhesive bond, thereby providing greater package strength and stability to the multiple layer package.

After placement of cover member 120, shrink wrap 122 is applied. Shrink wrap 122 may be applied by means of a shrink wrap applicator and shrink tunnel, or other means recognized in the art. An example of a suitable shrink film is a 1.5-mil low-density polyethylene, commercially available from Armin Plastics. FIG. 11 shows an end view of the multiple layer packaging assembly 110. Shrink wrap 122 has openings or film bullseyes 140 at either end thereof. Film bullseyes are openings of approximately one to three inches in diameter at either end of the package.

Frangible adhesive strips 124 hold containers 114 firmly in place on base member 112. Base member 112, containers 114,118, intermediate pad 116, cover member 120 and shrink wrap 122 cooperate to provide a support structure for the multiple layer container package assembly. The adhesive is such that it will adhere to containers 114,118 to the extent that the containers are secured to the base member and intermediate member, firmly enough to, in conjunction with cover member 120, resist movement relative thereto during normal handling. Since the center of gravity of containers 114,118 may cause the adhesive to break during handling without cover member 120, cover member 120 serves to prevent premature breaking of the frangible bond, and retain the shape of the package assembly should such breakage occur.

The layers of the multiple layer assembly are separated by removing plastic film 122 and cover member 120. Containers 114,118 are separated from the base member 112 and intermediate pad 116, respectively, by breaking the frangible adhesive. The adhesive can be broken by manual force by grasping and twisting an individual container and separating it from base member 112 or intermediate pad 116. Containers 114,118 separate cleanly from base member 112 and intermediate pad 116 without the need of a tear strip, as disclosed in the prior art (see FIG. 12). Containers 114, 118 may be retained on base member 112 or intermediate pad 116 until their removal is desired.

The following list of containers are exemplary of those with which the inventive multi-layer packaging assembly is of particular utility:

1. 32 oz. polypropylene container with 4.125" top diameter, 6.25" height and 2.875" base diameter when packaged into a 2×3 pack pattern in two layers.
2. 32 oz. polypropylene container with a 4.625" top diameter, 5.625" height and 3.25" base diameter when packaged into a 2×3 pack pattern in two layers.
3. 48 oz. polypropylene container with 5.0" top diameter, 6.75" height and 3.375" base diameter when packaged into a 2×3 pack pattern in two layers.
4. 1 liter polypropylene container with 4.625" top diameter, 5.5" height and 3.5" base diameter when packaged in a 2×3 pack pattern in two layers.

An important feature of the package assemblies having a cover member as described herein, including single layer and multiple layer packaging assemblies, is the ability to automatically palletize package assemblies of containers of unequal dimensions. This is an important distinction from the prior art. Some types of palletizing equipment require a flat top surface to pick-up product. The cover member provides a flat top surface. Other types of palletizing equipment push the product from the side. In this situation, the cover member in combination with the shrink wrap prevents not only premature release of the frangible bond, but also chiming or shingling. In this situation, the packaging assembly with a cover member prevents premature release of frangible bond. The cover member therefore prevents occurrence of phenomena which would negatively impact the integrity of the packaging assembly.

Figure 12:
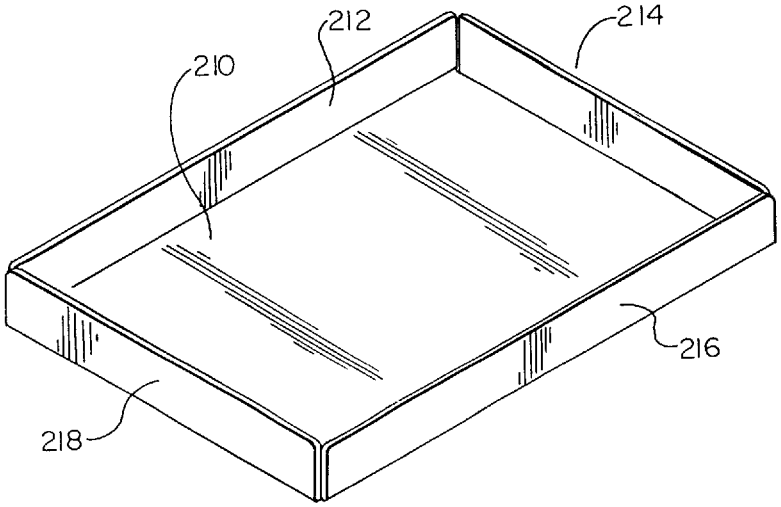
FIG. 12 is a perspective view of an alternative embodiment of a base member or intermediate member according to the present invention.
Figure 13:
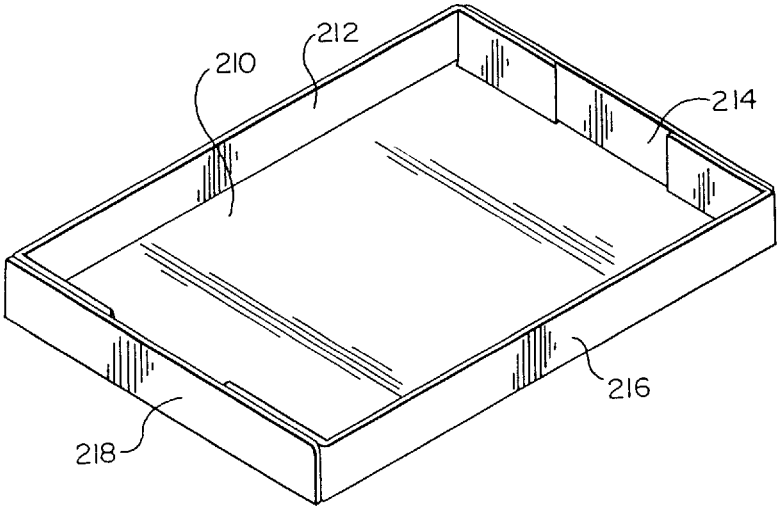
FIG. 13 is a perspective view as in FIG. 12 of a further alternative embodiment of a base member or intermediate member according to the present invention.
Figure 14:
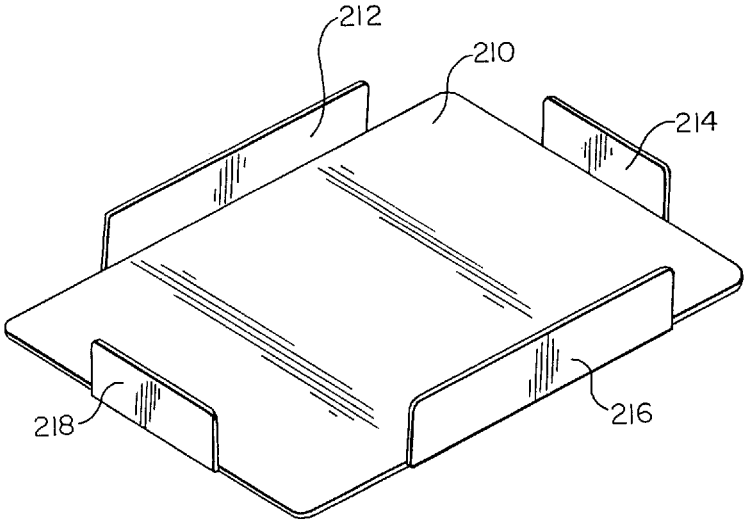
FIG. 14 is a perspective view of a still further alternative embodiment of a base member or intermediate member according to the present invention.

Referring now to FIGS. 12–18, alternative embodiments of a base or intermediate member in addition to those already shown are shown generally at 210. A perspective view of four sided base member 210 is shown at FIG. 12, base 210 having peripheral wall sections 212, 214, 216 and 218 extending in a direction perpendicular to base member 210. In the embodiment shown at FIG. 12, wall sections 212, 214, 216 and 218 are folded to extend perpendicularly from the base member to form an open tray wherein the wall sections are not affixed. Alternatively, as shown at FIG. 13, wall sections 212, 214, 216 and 218 may be affixed together to form a closed tray. FIG. 14 is a further alternative embodiment of base member 10 wherein wall sections 212, 214, 216 and 218 do not extend the entire length of the side from which they extend. Wall sections 212, 214, 216, and 218 are preferably approximately 1.00 to 1.50 inches in height.

Although any type of container may be packaged using the base or intermediate member having side walls, such a base member has particular utility with glass containers.

By means of adhesive dispensing equipment the nature of which will be readily apparent to those skilled in the art, strips of frangible adhesive 230 are placed on the upper surface 232 of base member 210. The adhesive may be applied by applicators situated above a conveyor along which base member 210 is traveling. Strips of an adhesive as defined herein are applied to the base member in a bead width of up to about ⅛ inch. The application temperature of the adhesive will be between about 250° to 350° F. The optimum application temperature will be determined by the specific container being packaged.

Modification of the adhesive dispensing equipment to provide an oscillating adhesive head (not shown) which moves up and down approximately 1.00 to 1.50 inches in response to placement of base member 210 provides proper adhesive placement on base member 210 given the 1.00 to 1.50 inch height of wall sections 212, 214, 216, and 218. The proper adhesive placement provided by the modified oscillating head prevents adhesive stringing of the viscous adhesive necessary for application of adhesive to a tray-like base member 210 as disclosed.

Figure 15:
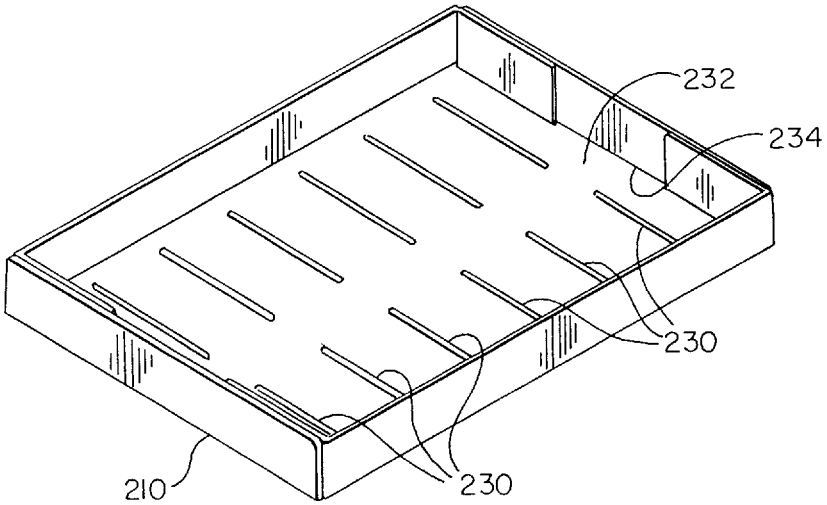
FIG. 15 is a perspective view as in FIG. 13 with intermittent strips of adhesive applied thereto.
Figure 16:
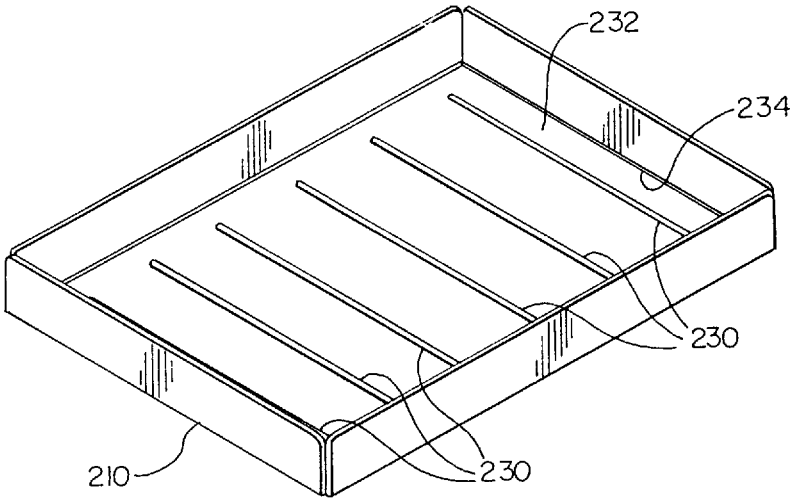
FIG. 16 is a perspective view of a base member as in FIG. 12 with strips of frangible adhesive applied thereto.
Figure 18:
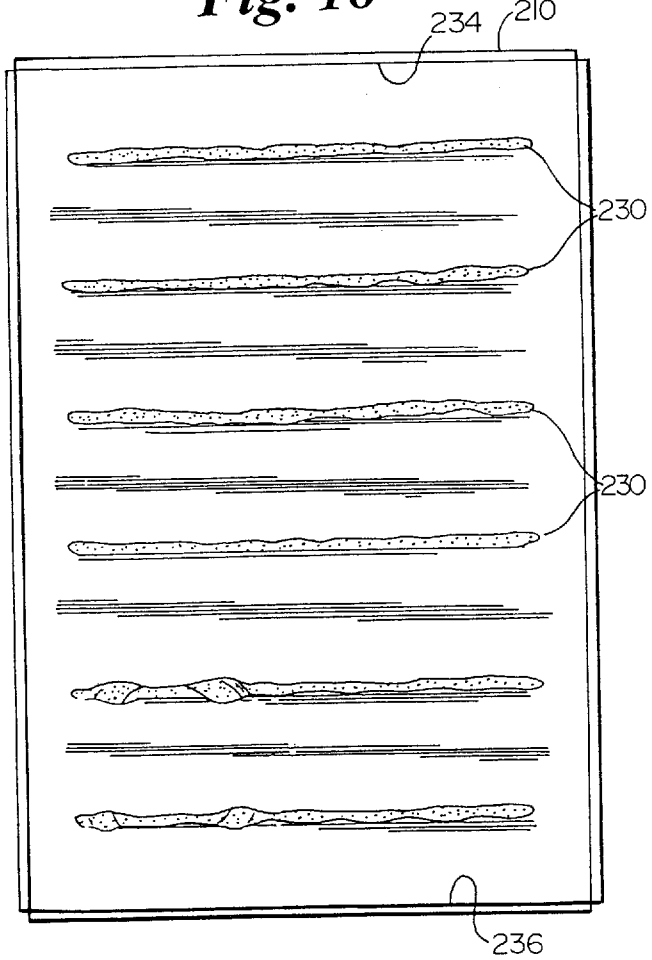
FIG. 18 is a top plan view of the embodiment shown in FIG. 13 with strips of adhesive applied thereto.
Figure 17:
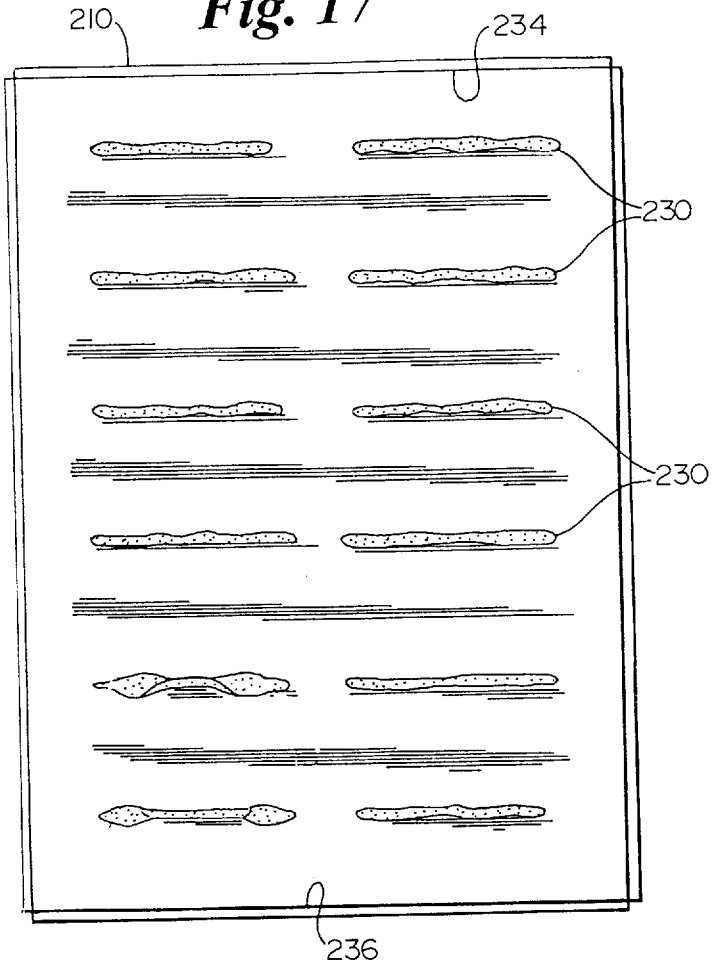
FIG. 17 is a plan view of the embodiment shown in FIG. 12 with intermittent strips of adhesive applied thereto.

Strips of frangible adhesive 230 are placed on the upper surface 232 of base member 210, as shown in FIGS. 15–18, adhesive strips 230 being disposed parallel to ends 234 and 236 of base member 210. FIGS. 15 and 17 show an embodiment of the invention in which adhesive strips 230 are intermittent, so that the adhesive strips extend only beneath the individual containers and not between them. FIGS. 16 and 18 show an embodiment of the invention in which adhesive strips 230 are continuous.

FIGS. 19–26 show perspective views of additional single and multiple layer packaging assemblies according to the present invention. Like elements of the single layer packaging assemblies are designated by the same numerals employed in FIG. 2, and like elements of the multiple layer packaging assemblies are designated by the same numerals employed in FIGS. 9–11. The pack patterns shown in these figures are exemplary and are in no way intended to limit particular containers to a specific pack pattern. The cover members of the multiple layer packaging assemblies are shown at about the lower size limit for a two layer packaging assembly according to the present invention.

Figure 19:
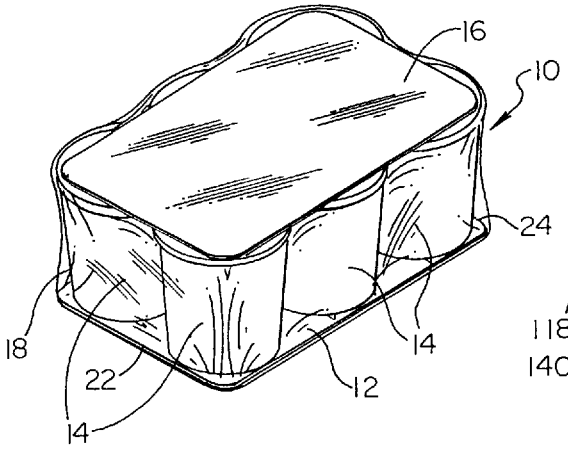
FIGS. 19–26 are perspective views of single layer and multiple layer packaging assemblies in accordance with the present invention.
Figure 20:
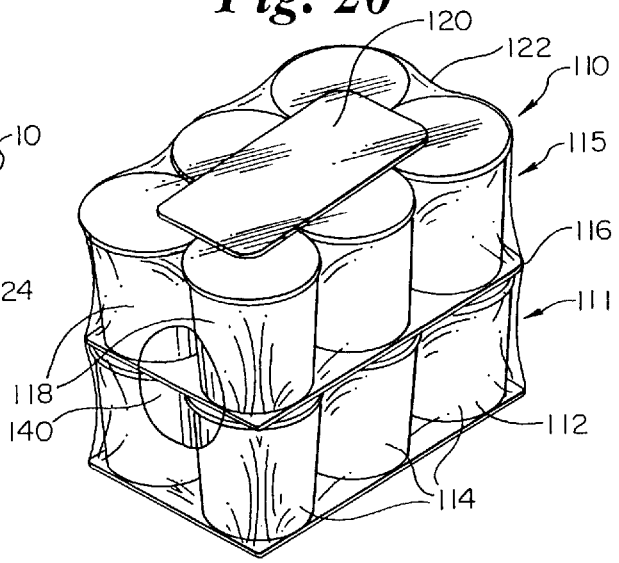

FIG. 19 is a perspective view of a single layer packaging assembly of 32 oz. polypropylene containers, the containers having a 4.625" top diameter, 5.625" height and 3.25" base diameter packaged into a 2×3 pack pattern in one layer. FIG. 20 is a perspective view of a two layer packaging assembly of 32 oz. polypropylene containers having a 4.625" top diameter, 5.625" height and 3.25" base diameter.

Figure 21:
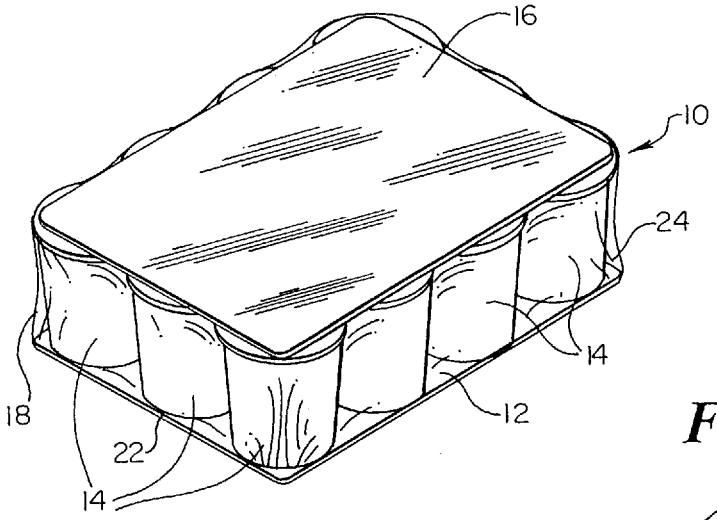
Figure 22:
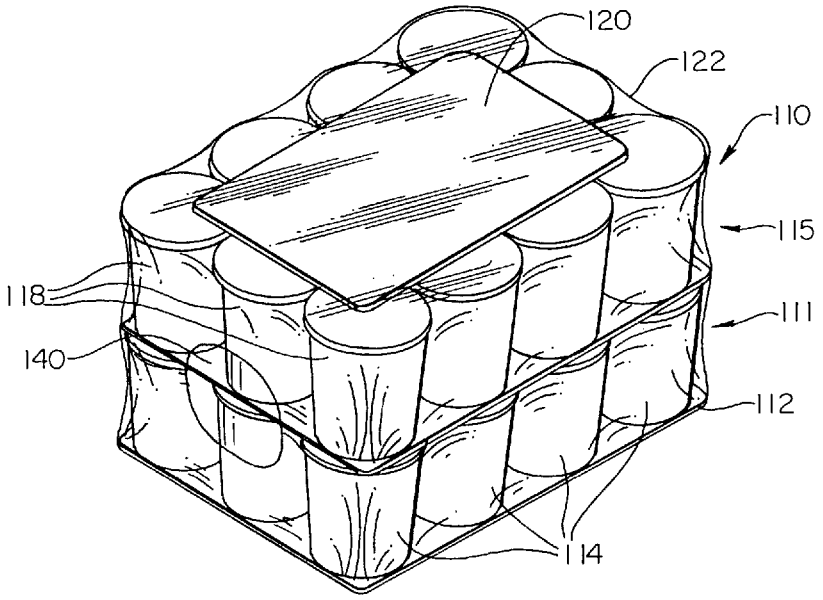

FIG. 21 is a perspective view of a single layer packaging assembly of 6 oz. polypropylene containers with a 3.25" top diameter, 3.0" height and 2.125" base diameter with false bottom base (container rim is only part of base to contact frangible adhesive) packaged in a 3×4 pack pattern. This configuration is also suitable for 8 oz. or 16 oz. containers of the same general shape. FIG. 22 is a perspective view of a double layer packaging assembly of 16 oz. high density polyethylene (HDPE) containers with a 3.875" top diameter, a 2.75" base diameter and a height of 4.375" packed in a 3×4 pack pattern. The containers may optionally have a false bottom base. This configuration is also suitable for 6 oz. or 8 oz. containers of the same general shape.

Figure 23:
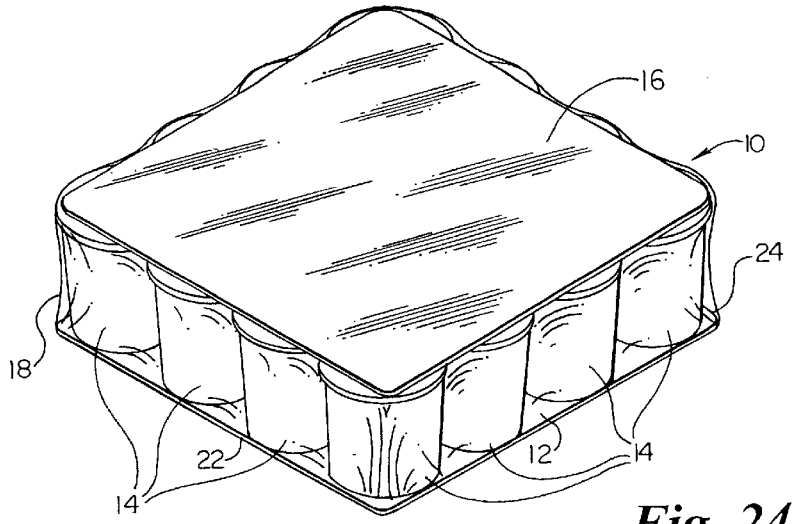
Figure 24:
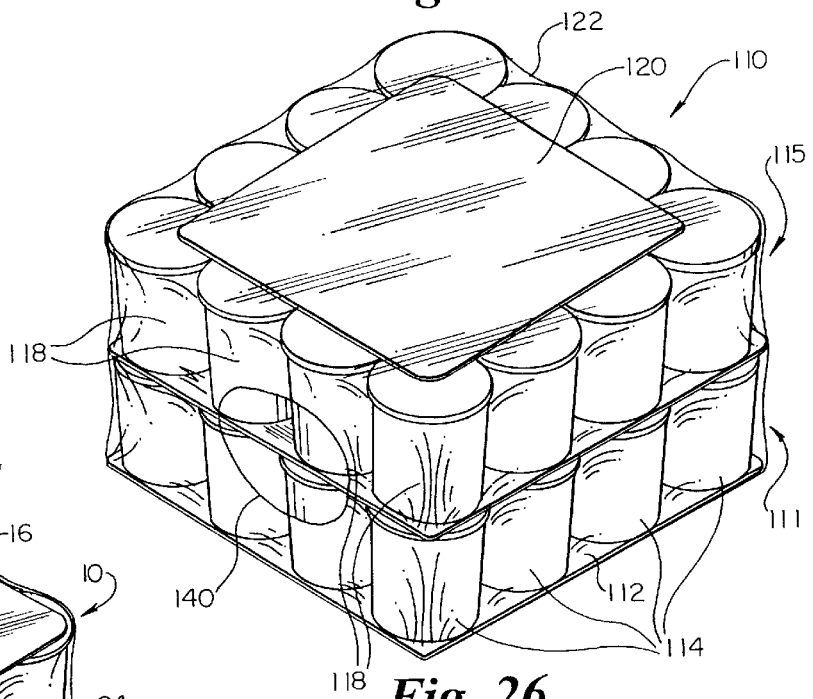

FIG. 23 is a perspective view of a single layer packaging assembly of cylindrical plastic coated paper containers in a 4×4 pack pattern. FIG. 24 is a perspective view of a two layer packaging assembly of cylindrical plastic coated paper containers in a 4×4 pack pattern, with a cover member shown at about the lower size limit for a two layer packaging assembly according to the present invention.

Figure 25:
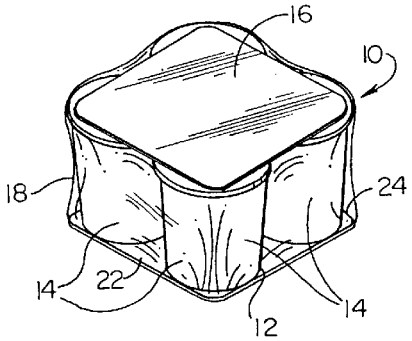
Figure 26:
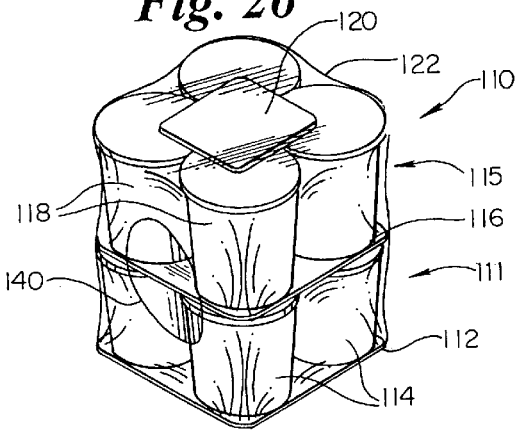

FIG. 25 is a perspective view of a single layer packaging assembly of 1 liter polypropylene container with 4.625" top diameter, 5.5" height and 3.5" base diameter packaged in a 2×2. FIG. 26 is a perspective view of a two layer packaging assembly of 1 liter polypropylene container with 4.625" top diameter, 5.5" height and 3.5" base diameter packaged in a 2×2 pack pattern. The cover member thereof is shown at about the lower size limit for a two layer packaging assembly according to the present invention.

The frangible adhesive may be the same as that used in U.S. Pat. No. 4,505,389. One such adhesive is commercially available from Swift Adhesives, Inc. of 383 Orendo Road, Bramalea, Ontario LGT-164 as Nicolmelt® hot melt adhesive. Other such adhesives are commercially available as well, such as H. B. Fuller Product HL-7505.

Alternatively, the most preferred adhesive may be defined as a hot melt adhesive which satisfies the following test conditions. These test conditions determine the temperature range at which the adhesive operates.

To determine the outer temperature limits of adhesive operability:

a) The first part of the test defines the temperature at which the adhesive bond created is too weak, i.e. the temperature above which the adhesive is operable. At a temperature of about 250° F. the adhesive is applied onto a base member in a bead width of up to about ⅛ inch thick, a container with a weight of about 1 lb. is placed on the adhesive bead within one to three seconds after the adhesive is placed onto the base member. The adhesive bond is left to cure for about 30 minutes. The base member is inverted and the container releases from the base member due to gravitational force with no adhesive residue on the container;

b) The second part of the test defines the temperature at which the adhesive bond created is too strong, i.e. the temperature below which the adhesive is operable. At a temperature of about 350° F., the adhesive is applied to a base member in a bead width of up to about ⅛ inch thick, a container weighing about 1 lb. is placed on the adhesive bead within one to three seconds after the adhesive is placed on the base member, the adhesive bond is left to cure for about 30 minutes, the base member is inverted and the container either i) does not release from the tray base due to gravitational force; or ii) releases and leaves adhesive residue on the container.

The adhesive is applied to the base member at a temperature between about 250° and 350° F. in a bead width of up to about ⅛ inch, each adhesive strip extending beneath a respective row of containers.

The proper frangible adhesive bond will be determined by a set adhesive application temperature, a set adhesive pump air pressure and the timing of adhesive application to the base member and container application to the base member. Increasing application temperature or air pump pressure will increase adhesive bond strength, and lowering either variable will decrease bond strength.

The ultimate specific adhesive application temperature, pump pressure and timing will be determined by a range of variables including size of the container, the temperature of the container, the material of which the container is made, the shape of the container, the degree of bonding possible between the container bottom and the base member (which is related to the size of the bonding surface at the base of the container as well as the temperature of the container), the weight of the container, the size of the packaging assembly and the modes of distribution and handling of a packaging assembly.

Once the correct setting has been determined to produce the required frangible bond (as described hereinabove), then adhesive application temperature, pump pressure and the time elapsed between application of the adhesive to the base member (or intermediate member) and application of the containers must be maintained as a constant. The following are examples of application conditions for various container types:

EXAMPLE 1

Container weight=32 ounces
Container dimensions=4.625" top diameter, 3.625" base diameter and 5.25" high
Container plastic type=polypropylene (PP)
Container base temperature=50–75 degrees F.
Hot melt adhesive=H.L. 7505 (supplied by H. B. Fuller)
Application temperature=300 to 325 degrees F.
Adhesive pump pressure=30 to 40 pounds per square inch (psi)
Adhesive nozzle size=0.015 inch
Condition of container bottom surface=dry
Time interval between adhesive application on base pad and containers loaded on the base pad to form the frangible bond=2 to 4 seconds

EXAMPLE 2

Container weight=16 ounces
Container dimensions=3.875" top diameter, 2.75" base diameter and 4.375" high
Container plastic type=high density polyethylene (HDPE)
Container base temperature=50–75 degrees F.
Hot melt adhesive=H.L. 7505 (supplied by H. B. Fuller)
Application temperature=265 to 290 degrees F.
Adhesive pump pressure=30 to 40 pounds per square inch (psi)
Adhesive nozzle size=0.015 inch
Condition of container bottom surface=dry
Time interval between adhesive application on base pad and containers loaded on the base pad to form the frangible bond=2 to 4 seconds

EXAMPLE 3

Container weight=24 ounces
Container dimensions=4.625" diameter, 3.25" base diameter and 4.75" high
Container plastic type=polypropylene (PP)
Container base temperature=50–75 degrees F.
Hot melt adhesive=H.L. 7505 (supplied by H. B. Fuller)
Application temperature=300 to 325 degrees F.
Adhesive pump pressure=30 to 40 pounds per square inch (psi)
Adhesive nozzle size=0.015 inch
Condition of container bottom surface=dry
Time interval between adhesive application on base pad and containers loaded on the base pad to form the frangible bond=2 to 4 seconds Unlike prior art packages and packaging methods, the present invention provides packaging assemblies which minimize materials while providing an area for displaying signage or billboards, product coding identification for handling in a system, UPC coding, bar coding or the like on multiple sides of the packaging assembly. Product information may be displayed on the individual containers of the packaging assembly, or on the base member or top pad. Applicant has explored various steps to solve the problems related to conveying easily accessible product information. Such product information on the individual containers is easily viewed through the shrink wrap, and may further be provided on the underside of the base member (not shown) or on the upper surface of the top pad. In addition, such information may be provided on the side walls of the base and intermediate members shown at FIGS. 3–4 and 12–18. Further, inserts, i.e. sheets of product information, may be added to the packaging assembly prior to the addition of the shrink wrap. Packaging assemblies according to the present invention solve the problem of providing easily accessible product information, in a container package assembly which provides the advantages of clean separation from the base member, suitability for a wide array of container types including containers of unequal dimensions, such as tubs and the like having a narrower base than top, containers having a increased height and volume and/or with a high center of gravity, including containers with a smaller base than top and containers with a larger base than top in addition to cylindrical containers of plastic, metal or paper.

Advantages of the container packaging assembly of the present invention are many. A primary advantage of the inventive packaging assembly is the clean release the container from the base member. Another distinct advantage is provided by the use of a corrugated base member which is not only instrumental to the strength of the container package assembly, but also contributes to the clean release of the containers.

The packaging assembly of the present invention provides an improvement over previous packaging assemblies for containers of the type requiring a base member with tear strips, onto which packages are removably secured to a tear strip by spots of frangible adhesive. The rigid base member of the present invention requires no tear strips, and uses frangible adhesive to removably secure the containers to the base member. The planar cover member provides an unexpectedly high degree of stability to the containers, when utilized in single or multiple layer packages.

The container package assemblies of the present invention provide a low cost, environmentally sound alternative for shipping food products. The package assemblies save money in labor costs and in packaging materials costs and are simple to disassemble at the store level. Further, containers packaged in the packaging assemblies of the present invention do not lose marketability because of the adherence of a tear strip or glue spots thereto as is common with prior packaging assemblies. The present packaging assembly provides clean release of the containers packaged therein.

Figure 27:
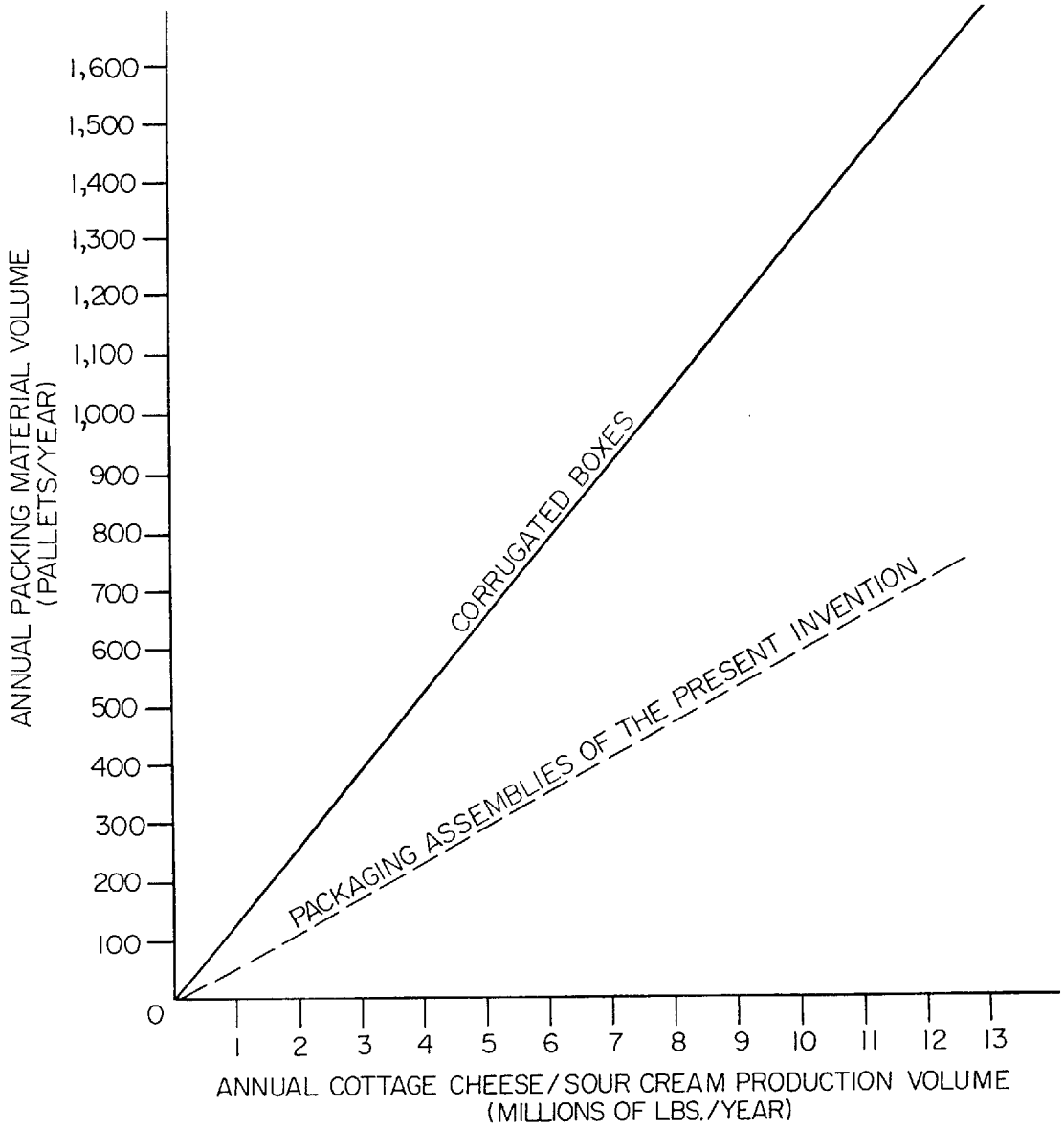
FIG. 27 is a graph depicting packaging material usage of the packaging assemblies according to the present invention relative to packaging material usage of corrugated boxes.
Figure 28:
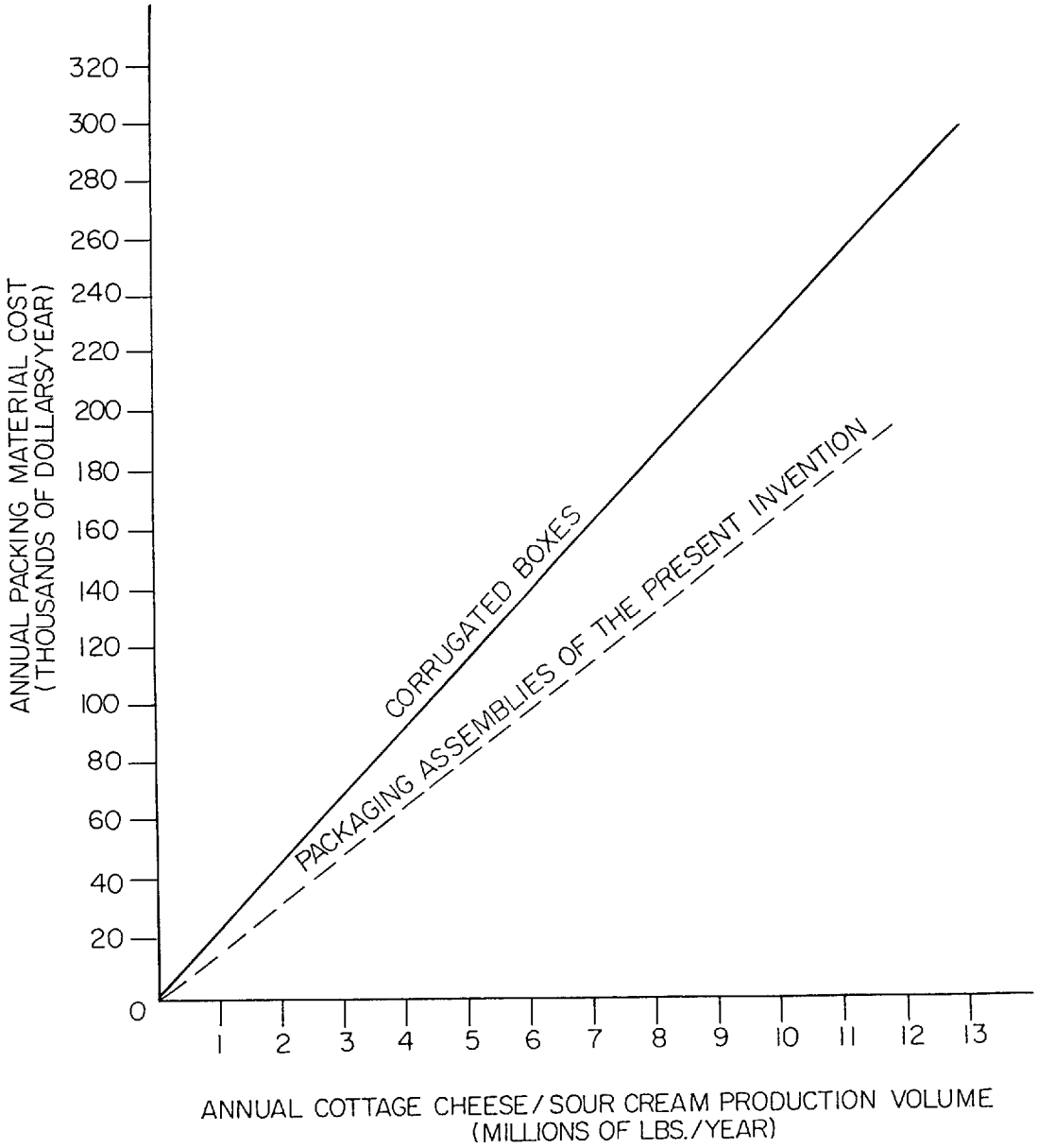
FIG. 28 is a graph as in FIG. 27, which depicts relative packaging material cost between the packaging assemblies of the present invention and corrugated boxes.

The package assembly is also environmentally friendly. Referring to FIG. 27, a comparison of packaging material usage in corrugated boxes, and the single and multi-layer packaging assemblies of the present invention is shown. The single layer packaging assembly according to the present invention replaces the use of corrugated boxes resulting in a reduction of 50% to 60% in the amount of packaging materials. Referring to FIG. 28, a comparison of packaging material cost is made. A switch from the use of a box to the use of the multiple layer packaging assembly according to the present invention leads to a reduction in materials of about 40% to 50%, which translates to a cost reduction of about 30%. In addition, all materials are recyclable after use while the base and cover members can be made from recycled paper.

The present invention also provides more rapid product cool-down after packaging than a corrugated box, providing a distinct advantage in the packaging of various food products. Unlike boxes, the inventive packaging assemblies do not have corrugated walls to insulate the product therein.

The inventive package assembly is especially ideal for packaging top heavy containers, such as tubs and the like, especially when used with products requiring rapid cool down after filling the containers, such as cottage cheese, sour cream, yogurt and the like. A pallet of packages according to the present invention has 1–2 inch air channels throughout the pallet due to tapered shape of the package. These air channels permit air to penetrate to the center of the pallet during the first 12 hours after the containers are filled to assist in cool-down of a products filled at relatively high temperatures. In addition, the film bullseyes of the multiple layer packaging assemblies increase air circulation to individual containers. With boxes as a packaging method, the center of the pallet has no significant air circulation.

This completes the description of the preferred and alternate embodiments of the invention. Those skilled in the art may recognize other equivalents to the specific embodiment described herein which equivalents are intended to be encompassed by the claims attached hereto.

What is claimed is:

1. A container package assembly consisting of a continuous, rigid planar base member made of corrugated board, said base member having at least one row of containers, the containers having a container base and a container top, said rows of containers being removably secured to the base member by frangible adhesive, said containers forming an array of containers secured to the base member; a planar cover member over said array of containers; and a film of plastic material passing over the containers, the cover member and the base member and secured to itself, to further secure the containers in assembly therewith, the containers being removable from the assembly by removing the plastic film and cover member and separating the containers from the base member by breaking the frangible adhesive with force to each container.

2. The packaging assembly of claim 1 wherein the cover member has dimensions no greater than the top dimension of the array of containers, whereby the containers of the container array have uncovered surfaces extending beyond the cover member, permitting the shrink wrap film to maintain tight contact with the container tops.

3. The packaging assembly of claim 1 wherein said rows of containers are secured to the base member by strips of frangible adhesive.

4. The container package assembly of claim 1 wherein the cover member is made of a material selected from the group consisting of paperboard, chipboard or corrugated material.

5. The container package assembly of claim 1 wherein the adhesive has greater adherence to the base than to the containers to cause substantially all of the adhesive to remain adhered to the base when the containers are removed therefrom.

6. The container package assembly of claim 5 wherein the at least one row of containers is a plurality of rows of containers and the frangible adhesive is a plurality of strips of adhesive, such that the base member has a plurality of strips of frangible adhesive, each adhesive strip extending beneath a respective row of containers, and wherein the container base is smaller than the container top, and the container has a large height and weight relative to the size of the container base.

7. The container package assembly of claim 6 wherein the adhesive strips are continuous.

8. The container package assembly of claim 6 wherein the adhesive strips are intermittent, such that each strip extends only the length of one container.

9. The container package assembly of claim 1 wherein the base member has four sides.

10. The container package assembly of claim 9 wherein the base and cover member are generally rectangular, the base and cover member each having four rounded corners.

11. The container package assembly of claim 9 wherein the base and cover member are generally rectangular, the base and cover member each having four clipped corners.

12. The container package assembly of claim 9 wherein the base member further comprises at least two opposing peripheral sections connected to and extending in a direction perpendicular to the base member.

13. The container package assembly of claim 12 wherein the base member further comprises four peripheral wall sections, one connected to each side of the base member, said wall sections extending in a direction perpendicular to the base member, whereby a tray for containers is provided.

14. The container package assembly of claim 13 wherein the peripheral wall sections are joined together to form a closed tray.

15. The package assembly of claim 1 wherein:

a) the adhesive is selected from a group consisting of all hot melt adhesives which satisfy the following conditions:

i) at a temperature of about 250° F. the adhesive is applied onto a base member in a bead width of up to ⅛ inch thick, a container with a weight of about 1 lb. is placed on the adhesive bead within one to three seconds after the adhesive is placed onto the base member, the adhesive bond is left to cure for about 30 minutes, the base member is inverted and the container releases from the base member due to gravitational force with no adhesive residue on the container; and ii) at a temperature of about 350° F., the adhesive is applied to a base member in a bead width of up to ⅛ inch thick, a container weighing about 1 lb. is placed on the adhesive bead within one to three seconds after the adhesive is placed on the base member, the adhesive bond is left to cure for about 30 minutes, the base member is inverted and the container either A) does not release from the tray base due to gravitational force; or B) releases and leaves adhesive residue on the container; and b) the adhesive is applied to the base member at a temperature between 250° F. and 350° F.

16. A container package assembly comprising:

a) a first layer of containers further comprising:

i) a continuous, planar corrugated base member;

ii) an array of containers, the containers having a container base and a container top, said containers being removably secured to the base member by frangible adhesive;

b) at least one additional layer of containers, said at least one additional layer further comprising;

i) a continuous, planar, corrugated intermediate member, said intermediate member being of the same size and dimensions as the base member;

ii) an array of containers, the containers having a container base and a container top, said containers being removably secured to the base member by frangible adhesive;

c) a cover member placed over said layers of containers, said cover member being the same size as the base member and intermediate member, whereby the base member, intermediate member and cover member are all the same size; and d) a film of plastic material passing over the containers, the cover member, the intermediate member and the base member and secured to itself, to further secure the containers in assembly therewith, the layers of containers being removable from the assembly by removing the plastic film and cover member and separating said layers of containers.

17. A container package assembly comprising:

a) a first layer of containers further comprising:

i) a continuous, planar corrugated base member;

ii) at least one strip of frangible adhesive on the base member;

iii) at least one row of containers, the containers having a container base and a container top having an outer rim, wherein the container base is smaller than the container top, and the container has a large height and weight relative to the size of the container base, said containers being removably secured to the base member by said strip of adhesive;

b) at least one additional layer of containers, said at least one additional layer further comprising:

i) a continuous, planar, corrugated intermediate pad, said intermediate pad being of the same size and dimensions as the base member;

ii) at least one strip of frangible adhesive on the intermediate pad;

iii) at least one row of containers, the containers having a container base and a container top having an outer rim, wherein the container base is smaller than the container top, and the container has a large height and weight relative to the size of the container base, said containers being removably secured to the intermediate pad by said strip of adhesive;

c) a cover member placed over said layers of containers, the dimensions of said cover member being such that the cover member lies within an outer perimeter of said layer of containers and uncovered surfaces of said containers extend beyond the cover member and wherein the base member, intermediate member and cover member are all the same size; and d) a film of plastic material passing over the containers, the cover member, the intermediate pad and the base member and secured to itself, to further secure the containers in assembly therewith, the layers of containers being removable from the assembly by removing the plastic film and cover member and separating said layers of containers, and said containers being removable from the layers of containers by separating the containers from the base member or intermediate pad by breaking the frangible adhesive with force to each container.

* * * * *

UNITED STATES PATENT AND TRADEMARK OFFICE

CERTIFICATE OF CORRECTION

PATENT NO. : 5,887,717

DATED : March 30, 1999

INVENTOR(S) : Dale Andersen

It is certified that error appears in the above-indentified patent and that said Letters Patent is hereby corrected as shown below:

ON THE TITLE PAGE

Item [19] Inventor "Anderson" should read --Andersen--;

At [75] delete "Anderson" and insert -- Andersen --;

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*